US006167827B1

(12) United States Patent
Keehan

(10) Patent No.: US 6,167,827 B1
(45) Date of Patent: Jan. 2, 2001

(54) MARITIME CHEMICAL TANKER HAVING COMPOSITE TANKS FOR STORING AND/OR TRANSPORTING LIQUID ORGANIC AND INORGANIC CHEMICALS AND THE LIKE

(75) Inventor: Donald J. Keehan, Bay Village, OH (US)

(73) Assignee: Guaranteed Advanced Tank Technologies International Ltd., Bridgetown (BB)

( * ) Notice: Under 35 U.S.C. 154(b), the term of this patent shall be extended for 0 days.

(21) Appl. No.: 09/318,873

(22) Filed: May 26, 1999

(51) Int. Cl.[7] ..... B63B 25/08
(52) U.S. Cl. ..... 114/74 A; 220/901
(58) Field of Search ..... 114/74 R, 74 A, 114/256; 220/901

(56) References Cited

U.S. PATENT DOCUMENTS 3,325,037 * 6/1967 Kohn et al. ..... 114/74 A
3,502,239 * 3/1970 Worboys et al. ..... 114/74 A
3,830,180 * 8/1974 Bolton ..... 114/74 A
3,927,788 * 12/1975 Zinniger et al. ..... 220/901
4,378,403 * 3/1983 Kotcharian ..... 220/901
5,368,184 * 11/1994 Fay et al. ..... 220/901

* cited by examiner

*Primary Examiner*—Jesus D. Sotelo
(74) *Attorney, Agent, or Firm*—Fay, Sharpe, Fagan, Minnich & McKee, LLP

(57) ABSTRACT

A maritime vessel is disclosed. The maritime vessel includes a hull and at least one cargo tank associated with the hull and having a multi-layered side wall construction. The side wall construction includes a first layer providing a corrosion barrier for the cargo tank, a second layer providing structural integrity for the cargo tank, a third layer providing impact energy absorption and buoyancy properties for the cargo tank, and a fourth layer providing fire-resistant properties for the cargo tank.

21 Claims, 6 Drawing Sheets

HONEYCOMB SANDWICH EFFICIENCY

| | T | 2T | 4T |
|---|---|---|---|
| RELATIVE STIFFNESS | 1 | 7 | 37 |
| RELATIVE STRENGTH | 1 | 3 | 7 |
| RELATIVE WEIGHT | 1 | 1.05 | 1.09 |

FIG. 10

MARITIME CHEMICAL TANKER HAVING COMPOSITE TANKS FOR STORING AND/OR TRANSPORTING LIQUID ORGANIC AND INORGANIC CHEMICALS AND THE LIKE

BACKGROUND OF THE INVENTION

The present invention relates to the composite tank arts. It finds particular application in conjunction with maritime chemical tankers having composite storage tanks for use in transporting and storing liquid organic and inorganic chemicals, and will be described with particular reference thereto. The present invention also finds application in conjunction with composite iso-tank containers for use in transporting and storing liquid organic and inorganic chemicals on maritime container ships, railroad cars, and roadway semi-trailers.

Seaborne trade in liquid organic and inorganic chemicals has grown tremendously over the past decade. This growth is accompanied with the ever present dangers of massive ecological damage should any of the present tanker ships have a chemical spill due to collision with another ship or ship breakup due to internal corrosion and/or rough seas.

With the growing demand for the transportation of hazardous chemicals by sea, new designs, safety equipment, and containment procedures have been developed. One such design is full, double-hulled ships with the port and starboard wings being used to carry less hazardous cargoes. Further, due to the inability of present coatings to resist the corrosive effects of the more aggressive cargoes, more and more chemical tanker's cargo tanks are being built of stainless steel. However, the cost for the stainless steel tanks can, on larger chemical tankers, cost as much as the rest of the ship, including the steel hull, engine room equipment and outfitting.

A major problem facing maritime chemical tanker operators and owners is the time spent in port which remains very long in relation to time spent at sea. Chemical tanker owners and operators face a port time of their entire fleet of deep-sea tankers of around 40%. This causes a tremendous loss in charter revenue. This port time is, in part, due to the requirement of washing and cleaning the cargo tanks prior to loading the next cargo. With present tanker designs, which incorporate integral rectangular stainless steel cargo tanks, large hard to reach surfaces have to be washed down with chemicals to remove the residue of the previous cargo. This takes an excessive amount of time plus it produces large quantities of hazardous waste water, typically referred to as "slops". Slops have to be treated and neutralized before being pumped overboard, or have to be pumped ashore for treatment. In either case, washing known rectangular stainless steel cargo tanks is a very costly and time consuming process.

It has been proposed to build cylindrical stainless steel tanks which are easier to clean. The use of cylindrical stainless steel cargo tanks reduces the amount of slops required to clean the cargo tanks, reduces the time spent in port cleaning the tanks, and reduces the costs associated with neutralizing the slops that are produced. However, it is more expensive to manufacturer cylindrical stainless steel cargo tanks. Thus, the use of cylindrical stainless steel cargo tanks increases the manufacturing cost of the ship, reduces carrying capacity of the cargo tanks due to loss of area of a cylinder versus that of a rectangle, and increases the weight and length of the ship in order to carry the same volume of cargo as a ship having rectangular cargo tanks.

Also, the transportation of liquid organic and inorganic chemicals by rail and over-the-road presents numerous hazards to humans, animals, and the environment.

Accordingly, it has been considered desirable to develop a new and improved composite storage tank for transporting and storing liquid organic and inorganic chemicals, which meets the above-stated needs and overcomes the foregoing difficulties and others while providing better and more advantageous results.

SUMMARY OF THE INVENTION

In accordance with one aspect of the present invention, a maritime vessel is disclosed. The maritime vessel includes a hull and at least one cargo tank associated with the hull and having a multi-layered side wall construction. The side wall construction includes a first layer providing a corrosion barrier for the cargo tank, a second layer providing structural integrity for the cargo tank, a third layer providing impact energy absorption and buoyancy properties for the cargo tank, and a fourth layer providing fire-resistant properties for the cargo tank.

In accordance with another aspect of the present invention, an iso-tank is disclosed. The iso-tank has a multi-layer sidewall construction including a first layer providing a corrosion barrier for the iso-tank, a second layer providing structural integrity for the iso-tank, a third layer providing impact energy absorption and buoyancy properties for the iso-tank, a fourth layer providing fire-resistant properties for the iso-tank, and a protective super-structure surrounding the iso-tank.

One advantage of the present invention is the provision of a lighter tonnage chemical tanker which incorporates multi-layer composite cargo tanks.

Another advantage of the present invention is the provision of a faster chemical tanker which can carry more cargo at the same draft in a smaller ship relative to stainless steel tank ships.

Yet another advantage of the present invention is the provision of a chemical tanker having 50% less shore time than stainless steel tank ships.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiments) and are not to be construed as limiting the invention.

FIG. 10 is a chart showing the performance characteristics of different honeycomb sandwich sidewall constructions each having a different thickness of honeycomb and/or high-density foam layer.

DETAILED DESCRIPTION OF THE PREFERRED EMBODIMENT (S)

Figure 1:
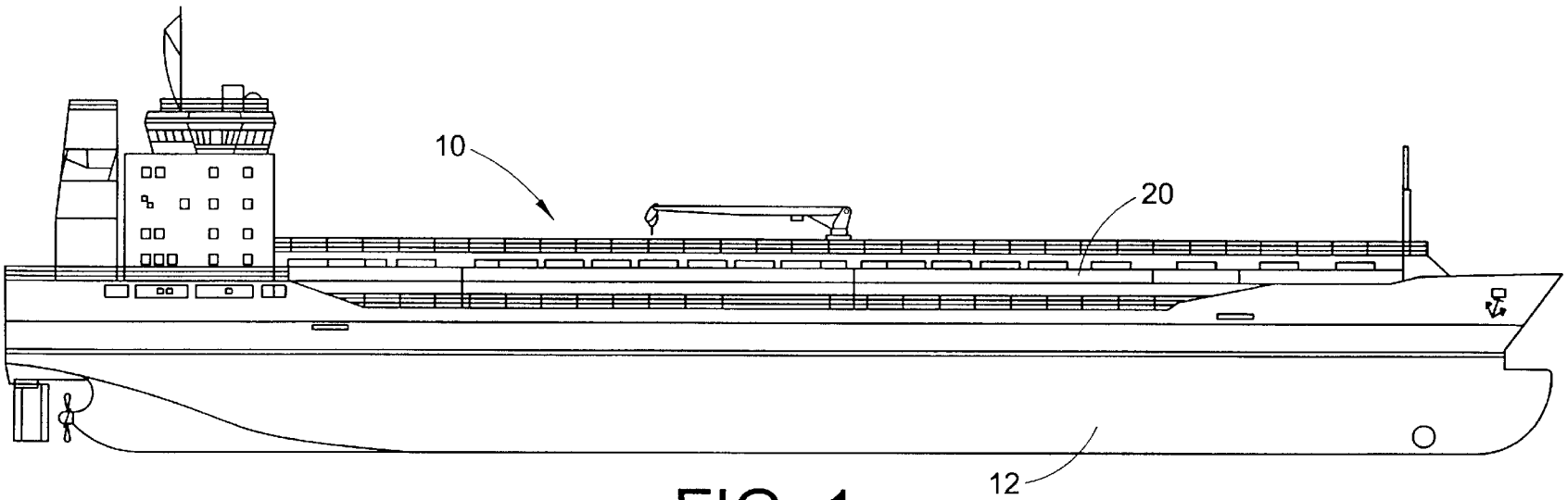
FIG. 1 is a side elevation view of an exemplary maritime chemical tanker which incorporates one or more composite storage tanks in accordance with a first embodiment of the present invention.
Figure 2:
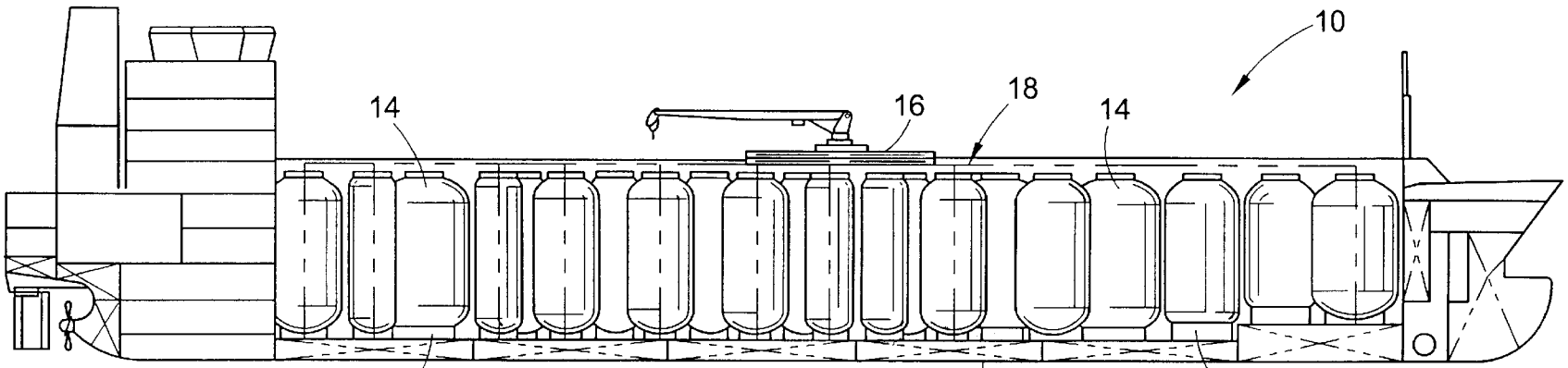
FIG. 2 is a longitudinal cross-section view of the chemical tanker of FIG. 1 taken along the line 2—2 in FIG. 3.
Figure 3:
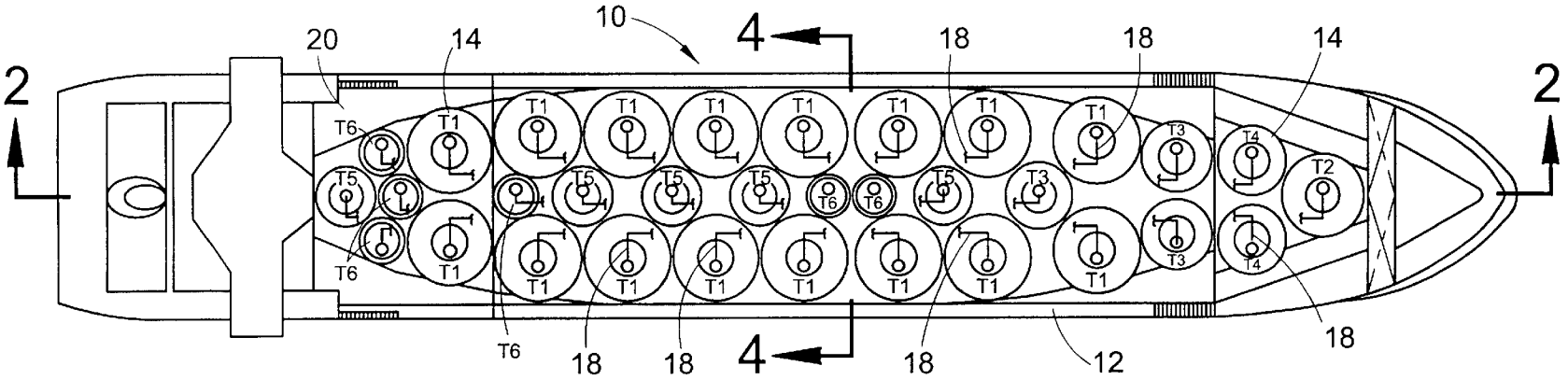
FIG. 3 is a top view of the chemical tanker of FIG. 1.
Figure 4:
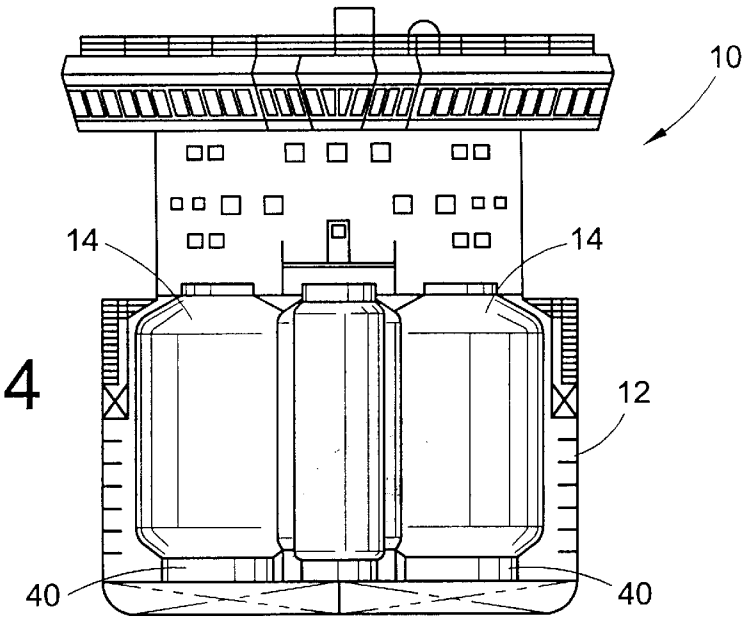
FIG. 4 is a cross-section view of the chemical tanker of FIG. 1 taken along the line 4—4 of FIG. 3.

With reference now to FIGS. 1–4, an exemplary maritime chemical tanker 10 includes a hull 12 having at least one or more composite storage tanks 14 therein. FIG. 3 illustrates an exemplary layout for the composite storage tanks 14 within the hull 12 of the chemical tanker 10. The composite storage tanks 14 have a substantially cylindrical shape, and have various capacity ratings for storing corrosive and non-corrosive liquid organic and inorganic chemicals such as crude oil, liquid natural gas (LNG), liquid propane gas (LPG), etc. Liquid organic and inorganic chemicals may be pumped into and out of the composite storage tanks 14 through a distribution manifold 16 and supply pipes 18 proximate a deck 20 of the chemical tanker 10.

In the embodiment being described, the volume of each of the composite storage tanks T1 is approximately 574 cubic meters ($M^3$); the volume of each of the composite storage tanks T2 is approximately 500 cubic meters ($M^3$); the volume of each of the composite storage tanks T3 is approximately 400 cubic meters ($M^3$); the volume of each of the composite storage tanks T4 is approximately 380 cubic meters ($M^3$) ; the volume of each of the composite storage tanks T5 is approximately 367 cubic meters ($M^3$); and the volume of each of the composite storage tanks T6 is approximately 241 cubic meters ($M^3$). As a result, the chemical tanker 10 may have a total cargo capacity of approximately 13,432.5 cubic meters ($M^3$).

The composite storage tanks 14 are separately secured to the hull 12 of the chemical tanker 10 by any suitable manner known in the art. Thus, the composite tanks are independent and not part of the chemical tanker's structure, thereby reducing the potential damage to the tanks 14 in the event the chemical tanker is ever damaged. Further, the tanks 14 can be removed and reused on a new tanker after the original tanker has reached its useful life.

Figure 5:
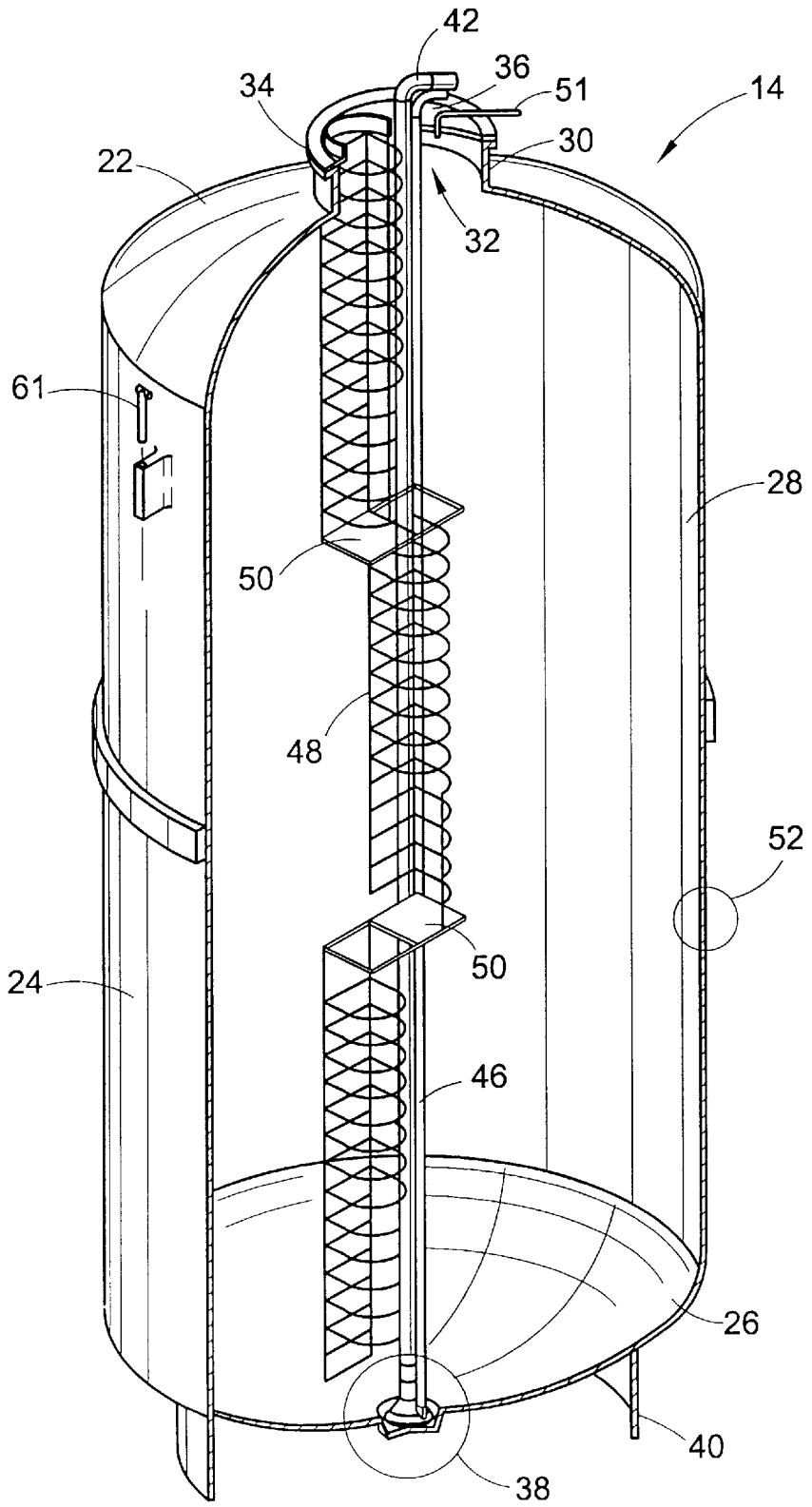
FIG. 5 is a cut-way view of a composite storage tank in accordance with the first embodiment of the present invention.
Figure 6:
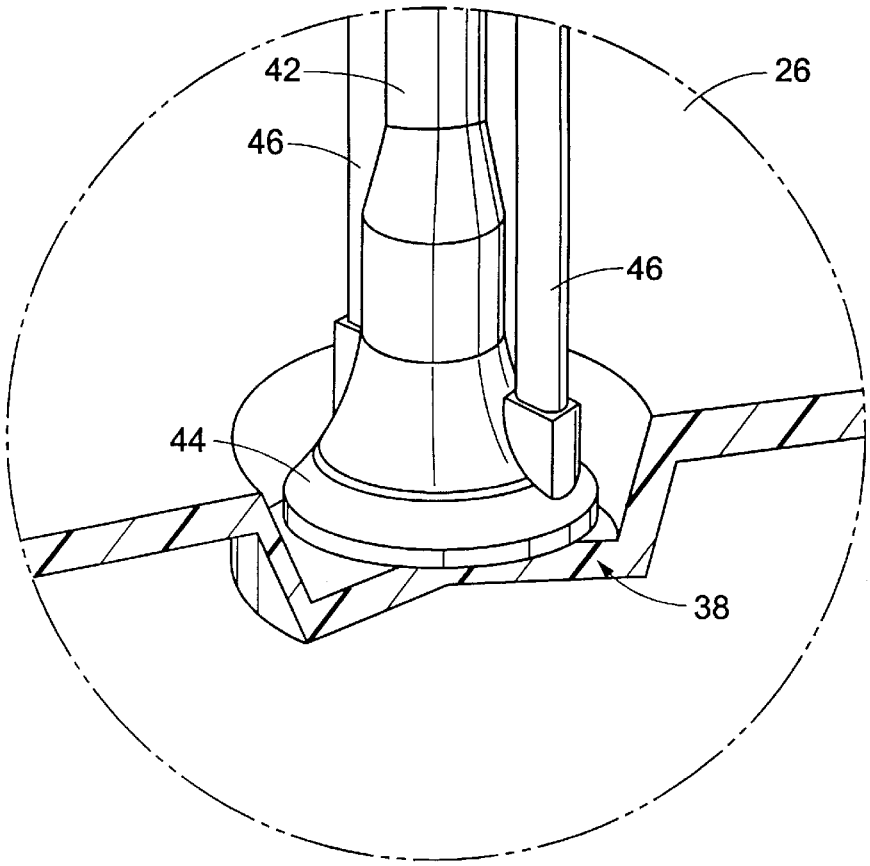
FIG. 6 is an enlarged perspective view of a sump region of the composite storage tank of FIG. 5.

Referring now to FIGS. 5 and 6, an exemplary composite storage tank 14 in accordance with a first embodiment of the present invention is shown. The composite storage tank 14 includes an integral upper dome portion 22, an upright cylindrical side wall portion 24, and a lower dome portion 26 which cooperate to define an interior cavity or chamber 28. A neck portion 30 extends from the upper dome 22 to define an opening or manway 32 into the tank 14. An annular flange 34 extends around an upper extent of the neck portion 30 to provide a sealing surface for receiving a lid or cap 36. A sump 38 is defined in the lowest extent of the lower dome 26. A skirt 40 extends from an exterior surface of the lower dome 26 to support the composite tank 14 within the hull 12 of the chemical tanker 10.

A main suction pipe 42 extends through the opening 32 into the chamber 28. A suction bell 44 extends from a lower free end of the main suction pipe 42. The suction bell 44 is positioned within the sump 38 to convey liquids stored in the tank 14 up through the main suction pipe 42 and out through the opening 32 to the manifold 16. At least one, and preferably two stripper pipes 46 extend from the opening 32 along the main suction pipe 42 into the suction bell 44 within the sump 38. The stripper pipes 46 convey slops that accumulate in the sump 38 during washing and cleaning of the tank 14 out through the opening 32. A ladder 48 can extend from the opening 32 along the main suction pipe 42 and stripper pipes 46 to the lower dome 26. One or more work platforms 50 may be positioned along the ladder 48 to permit a worker to enter into the tank during cleaning and/or inspection procedures. The ladder 48 and platforms) 50 can be formed from composite materials or inert materials to prevent chemical reactions with liquid chemicals that are stored and/or transported within the tank 14. Liquids can be pumped out of the tank in any manner known in the art. For instance, an inert gas such as nitrogen ($N_2$) can be pumped into the tank 14 through a supply pipe 51 to provide a blanket pressure of approximately 0.5 atmospheres to push the liquid out of the tank.

Figure 7:
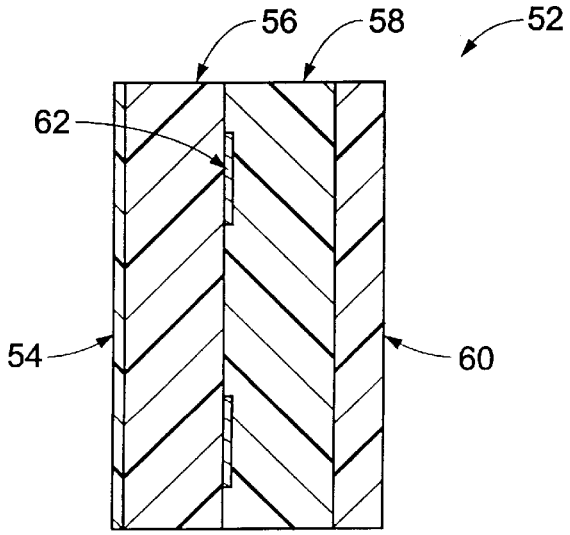
FIG. 7 is an enlarged cross-section view of a side wall of the composite storage tank of FIG. 5.

Referring now to FIG. 7, there is shown a cross-section of a multi-layered side wall 52 defining the composite storage tank 14. The side wall 52 includes a first or innermost corrosion barrier or corrosion-resistant layer 54. The corrosion barrier 54 is formed from at least a resin material such as organic/inorganic polymers, flouro polymers, etc., and reinforcement material such as carbon fibers, Teflon, polyester, etc., in the form of at least one thin sheet or veil which holds the resin material in place. In the preferred embodiment, the resin material is an organic/inorganic polymer such as a siloxirane and the reinforcement material is carbon fibers. It should be appreciated that carbon fibers reinforcement material facilitates discharging static electricity that builds up or is generated on the inner surface of the tank 14 due to fluid flow within the tank.

The thickness of the corrosion barrier 54 depends upon the particular capacity rating of the tank 14. For instance, the thickness of the corrosion barrier 54 for the larger cargo tanks T1 is in the range of about 0.060 to about 0.130 inches, and preferably about 0.100 inches, including about three layers or windings of reinforcement material. The thickness of the corrosion barrier 54 for the smaller cargo tanks T6 is in the range of about 0.048 to about 0.130 inches, and preferably about 0.0100 inches, including about three layers or windings of reinforcement material.

Alternatively, the corrosion barrier 54 could include a low surface energy fluorinated thermoplastic thin sheet liner such as a 5 to 10 mil (0.005 to 0.010 inches) thick polyvinylidene fluoride (PVDF) film which has a low permeability rate and is corrosion resistant to most chemicals. The low surface energy of PVDF is approximately 20 to 23 dynes per centimeter compared to stainless steel which is over 300 dynes per centimeter.

The low surface energy of PVDF or other fluorinated thermoplastics prevents cargoes from sticking to the inner side wall of the tank thereby allowing most liquids to drain to the bottom of the tank for easy pumping. Thus, only a small amount of hot water is required to clean the tanks for the next cargo. This reduces port time and the amount of slops generated. It is contemplated that a composite tank with a fluoropolymer liner can be cleaned in about 5 to 8 minutes, which represents a time savings of approximately 90% over the time required to clean a comparably sized stainless steel tank. The reduction of hazardous waste water or slops is also approximately 90%.

An inner wall 56 surrounds the corrosion barrier 54. The inner wall 56 is formed from at least a resin material such as organic/inorganic polymers, flouro polymers, etc., and a reinforcement material such as fiberglass, aramid carbon fibers, graphite fibers, organic fibers, etc. The inner wall 56 provides structural integrity to the tank 14. In the preferred embodiment, the resin material is an organic/inorganic polymer such as a siloxirane and the reinforcement material is fiberglass.

The thickness of the inner wall 56 depends upon the particular capacity rating of the tank 14. For instance, the thickness of the inner wall 56 for the larger cargo tanks Ti is in the range of about 0.125 to about 0.300 inches, and preferably about 0.250 inches, including about eight layers or windings of reinforcement material. The thickness of the inner wall 56 for the smaller cargo tanks T6 is in the range of about 0.100 to about 0.200 inches, and preferably about 0.150 inches, including about six layers or windings of reinforcement material.

A third layer 58 surrounds the inner wall 56. The third layer 58 can be formed from a honeycomb material, a high-density foam material, or a combination of honeycomb and high-density foam materials, etc. As shown in FIG. 10, the use of honeycomb and/or high-density foam materials for the third layer 58 results in a sandwiched sidewall construction that provides high strength with light weight. Further, the third layer 58 absorbs energy at a constant rate. The energy absorption is due to the loading increasing up to a peak value (bare compressive strength) before starting to crush at a uniform load (about 50% of the peak load) until it bottoms out (can no longer crush).

Thus, energy absorption property of the third layer 58 protects against spillage in the event that the chemical tanker 10 were to be hit by another ship or run aground. The third layer 58 not only provides structural integrity to the tank 14, but it also adds a buoyancy factor to the tank 14 that permits the tank 14 to float, even when full, should the chemical tanker 10 ever sink.

The composite storage tanks 14 may be secured to the hull 12 with shear pins or bolts 61 (FIG. 5) which permit the tanks 14 to break loose from the deck 20 in the event of high impact. This permits the tanks 14 to react like bowling pins and stack up against one another to cushion the load. The tanks 14 become oval or elliptical when a sufficient external load is present. This ellipticalization, along with the inherent energy absorption characteristics of the third layer 58, makes the composite cargo tanks 14 almost unbreakable. Further, the shear bolts permit the cargo tanks 14 to separate from the deck 20 and float free of the hull 12, thus preventing spillage in the event that the chemical tanker were to sink due to catastrophic damage.

In the preferred embodiment, the third layer 58 is formed from a rigid phenolic foam material having a density of approximately 6–9 lbs/sq. ft. The thickness of the layer 58 depends upon the particular capacity and buoyancy ratings of the tank 14. For instance, the thickness of the layer 58 for the larger cargo tanks T1 is in the range of about 1.00 to about 3.00 inches, and preferably about 1.50 inches. The thickness of the layer 58 for the smaller cargo tanks T6 is in the range of about 0.25 to about 2.00 inches, and preferably about 0.38 inches.

An outer wall 60 surrounds the third layer 58. The outer wall 60 is formed from at least a resin material such as organic/inorganic polymers, flouro polymers, etc., and a reinforcement material such as fiberglass, aramid carbon fibers, graphite fibers, organic fibers, etc. In the preferred embodiment, the resin material is a phenolic resin and the reinforcement material is fiberglass. The use of phenolic resin in the outer wall 56 not only provides additional structural integrity to the tank 14, but it also provides a fire resistance property to the tank 14.

Fire protection of double wall (inner wall 56 and outer wall 60) composite tanks can also be obtained by a number of other means, such as, but not limited to; 1) intumescent coatings which produce a ceramic-like insulating char at rapid temperature rises up to 2000° F. in five minutes, 2) fire retardant matrixes, 3) inorganic topcoat composites with steel mesh to dissipate localized heat or other such means, etc.

It should be appreciated that a potential fire hazard exists with single wall composite tank constructions because a single composite wall primarily provides structural integrity for a tank, as opposed to providing fire resistance. It should also be appreciated that a single wall composite tank construction is typically heavier than a comparably sized multi-wall composite tank construction because it does not include a high strength-to-weight ratio layer of honeycomb and/or high-density foam material like the third layer 58.

The thickness of the outer wall 60 depends upon the particular capacity and fire resistance ratings of the tank 14. For instance, the thickness of the outer wall 60 for the larger cargo tanks T1 is in the range of about 0.100 to about 0.300 inches, and preferably about 0.180 inches, including about nine layers or windings of reinforcement material. The thickness of the outer wall 60 for the smaller cargo tanks T6 is in the range of about 0.075 to about 0.200 inches, and preferably about 0.125 inches, including about five layers or windings of reinforcement material.

A number of sensing or monitoring devices 62 such as stress gauges, load cells, liquid level gauges, temperature gauges, thermal couples, etc., can be embedded between any of the multiple layers that form the side walls 52 of the storage tank 14, preferably during manufacture, to monitor various tank and/or liquid cargo parameters. In the embodiment being described, the sensing devices 62 are mounted between the inner wall 56 and the third layer 58. The sensing devices can be coupled to shipboard monitoring equipment (not shown) by wires and/or by telemetry antennas.

By incorporating stress gauges or load cells into the side wall of the lower dome portion 26, the actual amount of cargo in the tank can be accurately monitored. That is, by knowing the empty weight of the composite storage tank, the loaded weight of the composite storage tank, and the specific gravity of the cargo in the composite storage tank, the actual amount of cargo can be determined in a known manner.

In contrast, a known method of determining the amount of cargo in a maritime storage tank requires a very expensive and relatively inaccurate microwave sensing system which approximates the amount of cargo stored in a maritime tank by transmitting a microwave signal into the tank and measuring the elapsed time for the microwave signal to reflect off the surface of the cargo stored in the tank and return to the sensor.

Fiber optic wires can also be embedded within the side walls 52 of the storage tank 14, to allow for lighting within the tank. Video analysis of the inside of the tank increases safety for ship personnel by eliminating the need for a person to enter into a tank that could contain poisonous gases.

As previously mentioned, to compensate for the lost cargo volume when using cylindrical stainless steel maritime tanks, compared to rectangular stainless-steel maritime tanks, the size (i.e. length and/or berth) of the chemical tanker must be increased. However, because the weight of cylindrical composite maritime tanks 14 are less than comparably-sized cylindrical stainless maritime tanks. By way of comparison, a composite tank T1 in accordance with the present invention weighs approximately 25,000 lbs while a stainless steel tank of substantially equal capacity weighs approximately 110,000 lbs. It should be appreciated that the height of cylindrical composite maritime tanks 14 can be increased to compensate for lost cargo volume without increasing the size of the chemical tanker.

Thus, by using composite materials, cylindrical, oval, or other elliptically-shaped maritime storage tanks can be used to reduce the weight of a chemical tanker while permitting an increased carrying capacity. Further, the use of composite materials reduces the initial, operating and maintenance costs of a chemical tanker, in part because composite tanks cost less than stainless steel tanks, and a standard design high-speed container ship or bulk carrier hull can be used.

By utilizing a conventional double hull chemical tanker and the double wall, i.e., inner wall 56 and outer wall 60, composite maritime storage tanks 14 of the present invention, a quadruple structure or hull is formed. A quadruple structure or hull provides twice the protection of a conventional chemical tanker incorporating stainless steel cargo tanks. Further, by building maritime chemical tankers with the double wall composite tanks 14, the tanks 14 can be individually removed and replaced with other tanks designed to handle pressurized cargoes, low or high temperature cargoes, or to repair or upgrade existing tanks. Due to the double wall insulative qualities the tanks 14, a tank with a hot cargo (100° C.) can be positioned next to a tank with a cold cargo (−28° C.). This cannot be achieved with present stainless steel tank vessels.

In sum, the use of composite double wall maritime storage tanks results in a lighter weight chemical tanker that can carry more cargo at same draft in a smaller ship, that can operate at a faster speed, that reduces port time by 50% over stainless steel tank ships, and that generates 90% less hazardous waste (slop).

Further, composite maritime storage tanks in accordance with the present invention can carry all International Maritime Organization (IMO) approved cargoes without corrosion. Unlike the composite storage tanks of the present invention, the exterior surfaces of stainless steel maritime tanks must be coated to resist salt water corrosion/penetration that causes chloride stress cracking of the stainless steel.

Figure 8:
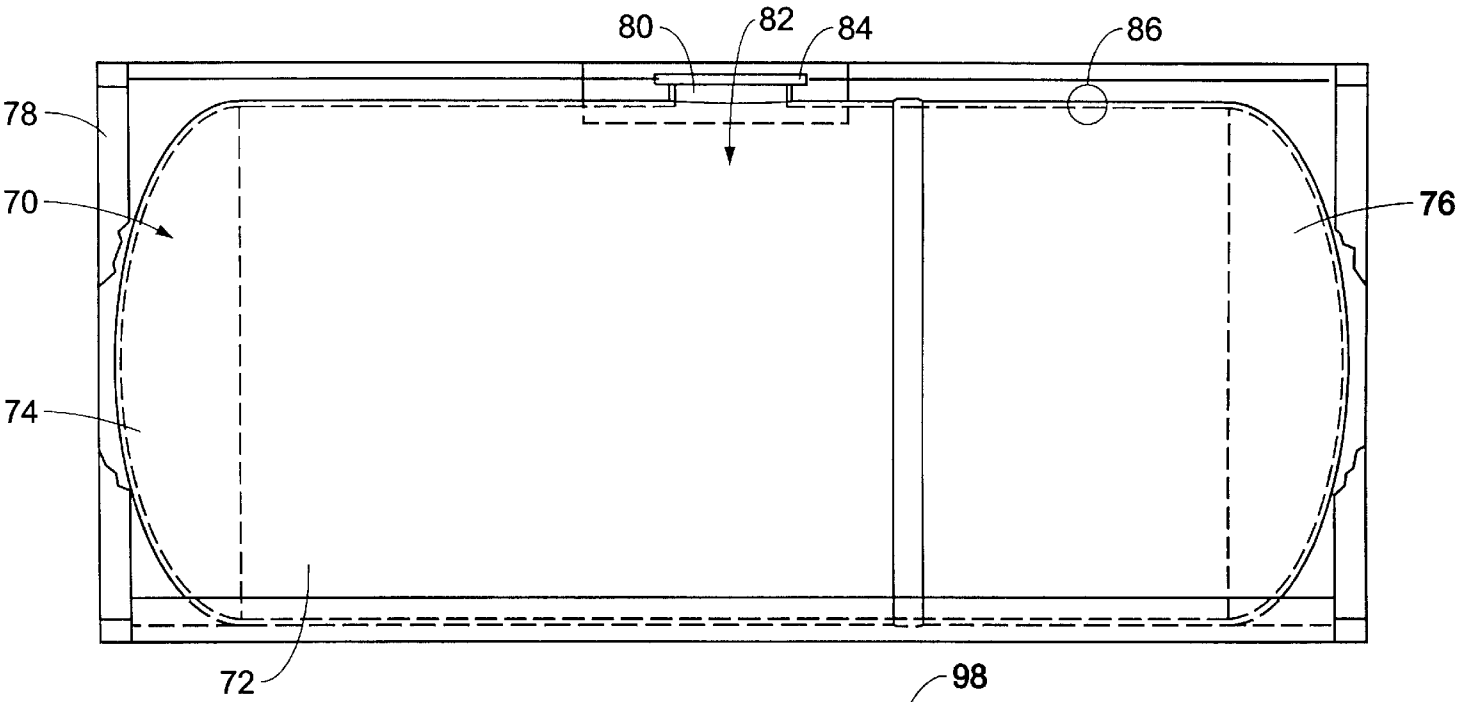
FIG. 8 is a side elevation view of composite storage tank in accordance with a second embodiment of the present invention.

Referring now to FIG. 8, there is shown a composite storage or ISO tank 70, in accordance with another embodiment of the present invention. The ISO tank 70 includes a horizontally-oriented cylindrical portion 72 and two domed-end portions 74, 76 formed integrally with respective ends of the cylindrical portion 72. A substantially rectangular frame or superstructure 78 surrounds the ISO tank 70. The superstructure 78 protects the ISO tank 70 from damage, and permits the ISO tank 70 to be transported over land by semi-trailer, or by rail car. Further, the superstructure 78 permits multiple ISO tanks 70 to be stacked for transport on conventional maritime container ships.

A neck portion 80 extends upward from the cylindrical portion 72 to define an opening 82 into the ISO tank 70. An annular flange 84 extends around an upper extent of the neck portion 80 to provide a sealing surface for receiving a lid or cap (not shown). It should be appreciated that the composite tank 70 has a much smaller cargo capacity than the maritime storage tanks 14. In particular, the volume of the composite ISO tank 70 is approximately 50 cubic meters ($M^3$). Because the ISO tank 70 is movable, it is desirable to increase the structural integrity of the side wall 86 relative to the composite maritime tanks 14 of FIG. 5.

Figure 9:
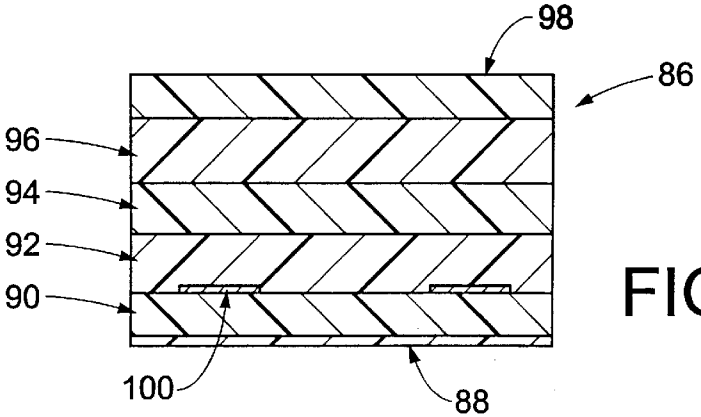
FIG. 9 is an enlarged cross-section view of a side wall of the composite storage tank of FIG. 8.

Referring now to FIG. 9, there is shown a cross-section view of the multi-layered side wall 86 defining the composite ISO tank 70. As with the side wall 52, the construction of the side wall 86 includes a first or innermost corrosion barrier 88. The corrosion barrier 88 is formed from at least a resin material such as organic/inorganic polymers, flouro polymers, etc., and reinforcement material such as carbon fibers, Teflon, polyester, etc., in the form of at least one thin sheet or veil which holds the resin material in place. In the preferred embodiment, the resin material is an organic/inorganic polymer such as a siloxirane and the reinforcement material is carbon fibers. It should be appreciated that carbon fibers reinforcement material facilitates discharging static electricity generated or built up within the inner surface of the tank 70 due to the flow of fluids into and out of the tank.

The thickness of the corrosion barrier 88 depends upon the particular capacity rating of the tank 14. In the embodiment being described, the thickness of the corrosion barrier 88 is in the range of about 0.042 to about 0.100 inches, and preferably about 0.060 inches, including about two or three layers or windings of reinforcement material.

Alternatively, the corrosion barrier 88 could include a low surface energy fluorinated thermoplastic thin sheet liner such as a 5 to 10 mil (0.005 to 0.010 inches) thick polyvinylidene fluoride (PVDF) film which has a low permeability rate and is corrosion resistant to most chemicals. The low surface energy of PVDF is approximately 20 to 23 dynes per centimeter compared to stainless steel which is over 300 dynes per centimeter. The low surface energy of PVDF or other fluorinated thermoplastics prevent cargoes from sticking to the inner side wall of the tank thus allowing most cargoes to drain to the bottom of the tank for easy pumping and cleaning.

An inner wall 90 surrounds the corrosion barrier 88. The inner wall 90 is formed from at least a resin material such as organic/inorganic polymers, flouro polymers, etc., and a reinforcement material such as fiberglass, aramid carbon fibers, graphite fibers, organic fibers, etc. The inner wall 90 provides structural integrity to the tank 70. In the preferred embodiment, the resin material is an organic/inorganic polymer such as a siloxirane and the reinforcement material is fiberglass.

The thickness of the inner wall 90 depends upon the particular capacity rating of the tank 70 and the thickness of the other structural layers of the side wall 86 as described further below. In the embodiment being described, the thickness of the inner wall 90 is in the range of about 0.030 to about 0.100 inches, and preferably about 0.060 inches, including about four layers or windings of reinforcement material.

A first layer of energy absorption material 92 surrounds the inner wall 90. The energy absorption material 92 can be formed from a honeycomb material, a high-density foam material, or a combination of honeycomb and high-density foam materials, etc. The use of honeycomb and/or high-density foam materials for the layer 92 results in a sandwiched sidewall construction that provides high strength with light weight. Further, the energy absorption material 92 absorbs energy at a constant rate. The energy absorption is due to the loading increasing up to a peak value (bare compressive strength) before starting to crush at a uniform load (about 50% of the peak load) until it bottoms out (can no longer crush).

The energy absorption property of the layer 92 protects against spillage in the event that the tank 70 were to be damaged. The tank 70 becomes oval or elliptical when a sufficient external load is present. This ellipticalization, along with the inherent energy absorption characteristics of at least the layer 92, makes the composite cargo tank 70 almost unbreakable. In the preferred embodiment, the layer 92 is formed from a combination of honeycomb and high-density foam materials having a rating of 6 to 9 lbs/sq. ft. The honeycomb material can have any suitable cell construction such as rectangle, pentagram, quintuple, and preferably, sextuple or octagonal. The thickness of the layer 92 depends upon the desired level of structural integrity for the tank 70. For instance, the thickness of the layer 92 is in the range of about 0.25 to about 0.50 inches, and preferably about 0.38 inches.

A middle wall 94 surrounds the layer of energy absorption material 92. As with the inner wall 90, the middle wall 94 is formed from at least a resin material such as organic/inorganic polymers, flouro polymers, etc., and a reinforcement material such as fiberglass, aramid carbon fibers, graphite fibers, organic fibers, etc. The middle wall 94 also provides structural integrity to the tank 70. In the preferred embodiment, the resin material is an organic/inorganic polymer such as a siloxirane and the reinforcement material is fiberglass.

The thickness of the middle wall 94 depends upon the particular capacity rating of the tank 70 and the thickness of the other structural layers of the side wall 86. In the embodiment being described, the thickness of the middle wall 94 is in the range of about 0.040 to about 0.150, and preferably about 0.080, including about five layers or windings of reinforcement material.

A second layer of energy absorption material 96 surrounds the middle wall 94. As with the layer 92, the layer 96 can also be formed from a honeycomb material, a high-density foam material, or a combination of honeycomb and high-density foam materials, etc. And, the use of honeycomb and/or high-density foam materials for the layer 96 results in a double sandwich sidewall construction that provides higher strength with lighter weight relative to the single sandwich sidewall construction of FIG. 7. However, it should be appreciated that substantially the same strength to weight ratio of the sidewall 86 can be achieved by varying the performance characteristics of one or more of the layers that form the sidewall 52, such that the thickness of one or more of the layers 56–60, the material composition of the layers 56–60, etc.

The energy absorption property of the layer 96 increases the protection against spillage in the event that the tank 70 were to be damaged. In the preferred embodiment, the layer 96 is formed from a rigid phenolic foam material having a density of approximately 6–9 lbs/sq. ft. The thickness of the layer 96 depends upon the desired level of structural integrity for the tank 70. For instance, the thickness of the layer 96 is in the range of about 0.25 to about 0.100 inches, and preferably about 0.38 inches.

An outer wall 98 surrounds the layer 96. The outer wall 98 is formed from at least a resin material such as organic/inorganic polymers, flouro polymers, etc., and a reinforcement material such as fiberglass, aramid carbon fibers, graphite fibers, organic fibers, etc. In the preferred embodiment, the resin material is a phenolic resin and the reinforcement material is fiberglass. The use of phenolic resin in the outer wall 98 not only contributes to the structural integrity of the tank 70, but it also provides a fire resistance property to the tank 70.

Fire protection of the triple wall (inner wall 90, middle wall 94 and outer wall 98) composite tank 70 can also be obtained by a number of other means, such as, but not limited to; 1) intumescent coatings which produce a ceramic-like insulating char at rapid temperature rises up to 2000° F. in five minutes, 2) fire retardant matrixes, 3) inorganic topcoat composites with steel mesh to dissipate localized heat or other such means, etc.

The thickness of the outer wall 98 depends upon the desired level of structural integrity and the desired level of fire resistance for the tank 70. In the preferred embodiment, the thickness of the outer wall 98 is in the range of about 0.050 to about 0.250 inches, and preferably about 0.125 inches, including about nine layers or windings of reinforcement material.

A number of sensing or monitoring devices 100 such as stress gauges, load cells, liquid level gauges, temperature gauges, thermal couples, etc., can be embedded between any of the layers forming the side walls 86 of the storage tank 70, preferably during manufacture, to monitor various tank and/or liquid cargo parameters. In the embodiment being described, the sensing devices 100 are mounted between the inner wall 56 and the first energy absorption layer 92. The sensing devices can be coupled to external monitoring equipment (not shown) by wires or by telemetry antennas.

By incorporating stress gauges or load cells into the lower portion of the tank 70, such as the central cylindrical portion 72, the actual amount of cargo in the tank can be accurately monitored. That is, by knowing the empty weight of the composite storage tank, the loaded weight of the composite storage tank, and the specific gravity of the cargo in the composite storage tank, the actual amount of cargo can be determined in a known manner.

Fiber optic wires can also be embedded within the side walls 86 of the storage tank 70, to allow for lighting within the tank. Video analysis of the inside of the tank increases safety for ship personnel by eliminating the need for a person to enter into a tank that could contain poisonous gases.

The invention has been described with reference to the preferred embodiment(s). Obviously, modifications and alterations will occur to others upon reading and understanding the preceding detailed description. It is intended that the invention be construed as including all such modifications and alterations insofar as they come within the scope of the appended claims or the equivalents thereof.

For instance, the composite storage tanks of the present invention can be placed onboard maritime vessels other than ocean-going ships, such as river barges, and other types of seaborne structures.

Further, the present invention contemplates the use of various other multi-layered side wall constructions for composite storage tanks incorporating additional or fewer structural layers, additional or fewer energy absorption layers, and additional or fewer corrosion barriers and/or fire resistance layers, etc. The side wall constructions shown in FIGS. 7 and 9 are for purposes of illustration only and are not to be construed as limiting the present invention.

Having thus described the preferred embodiment(s), the invention is now claimed to be:

1. A maritime vessel, comprising:

a hull; and at least one cargo tank associated with the hull and having a multi-layered side wall construction including a first layer providing a corrosion barrier for the cargo tank, a second layer providing structural integrity for the cargo tank, a third layer providing impact energy absorption and buoyancy properties for the cargo tank, and a fourth layer providing fire-resistant properties for the cargo tank.

2. The vessel of claim 1, wherein the first layer defines an inner layer of the cargo tank, the second layer surrounds the first layer, the third layer surrounds the second layer, and the fourth layer surrounds the third layer and defines an outer layer of the cargo tank.

3. The vessel of claim 1, wherein the first corrosion-resistant layer is formed from a resin material and a reinforcement material.

4. The vessel of claim 1, wherein the first corrosion-resistant layer is formed from a siloxirane resin material and a carbon fibers reinforcement material.

5. The vessel of claim 1, wherein the first corrosion-resistant layer includes a fluorinated thermoplastic material.

6. The vessel of claim 1, wherein the first corrosion-resistant layer includes a polyvinylidene fluoride (PVDF) film material.

7. The vessel of claim 1, wherein the second layer is formed from a resin material and a reinforcement material.

8. The vessel of claim 1, wherein the second layer is formed from a siloxirane resin material and a reinforcement material from the group consisting of fiberglass, aramid carbon fibers, graphite fibers, and organic fibers.

9. The vessel of claim 1, wherein the third layer is formed from at least one of a honeycomb-shaped material and a high-density foam material.

10. The vessel of claim 1, wherein the third layer is formed from a rigid phenolic foam material having a density of about 6.0 to about 9.0 pounds per square foot.

11. The vessel of claim 1, wherein the fourth layer is formed from a resin material and a reinforcement material.

12. The vessel of claim 1, wherein the fourth layer is formed from a phenolic resin material and a reinforcement material from the group consisting of fiberglass, aramid carbon fibers, graphite fibers, and organic fibers.

13. The vessel of claim 1, wherein the cargo tank is mounted to the hull by a plurality of shear pins.

14. The vessel of claim 1, further including a superstructure surrounding the cargo tank to facilitate transporting the cargo tank on a deck of the hull.

15. The vessel of claim 1, further including a parameter sensing device embedded within the sidewall of the cargo tank.

16. The vessel of claim 1, wherein:

the first corrosion-resistant layer is formed from a siloxirane resin material and a carbon fibers reinforcement material;

the second layer is formed from a siloxirane resin material and a reinforcement material from the group consisting of fiberglass, aramid carbon fibers, graphite fibers, and organic fibers;

the third layer is formed from a rigid phenolic foam material having a density of about 6.0 to about 9.0 pounds per square foot; and the fourth layer is formed from a phenolic resin material and a reinforcement material from the group consisting of fiberglass, aramid carbon fibers, graphite fibers, and organic fibers.

17. The vessel of claim 16, wherein the first layer defines an inner layer of the cargo tank, the second layer surrounds the first layer, the third layer surrounds the second layer, and the fourth layer surrounds the third layer and defines an outer layer of the cargo tank.

18. The vessel of claim 17, further including at least one parameter sensing device embedded between the first and second layers.

19. The vessel of claim 18, wherein the cargo tank is mounted to the hull by a plurality of shear pins.

20. The vessel of claim 18, further including a superstructure surrounding the cargo tank to facilitate transporting the cargo tank on a deck of the hull.

21. An iso-tank having a multi-layer sidewall construction comprising:

a first layer providing a corrosion barrier for the iso-tank;

a second layer providing structural integrity for the iso-tank;

a third layer providing impact energy absorption and buoyancy properties for the iso-tank;

a fourth layer providing fire-resistant properties for the iso-tank; and a protective super-structure surrounding the iso-tank.

* * * * *